United States Patent [19]

Jhono

[11] 4,283,831

[45] Aug. 18, 1981

[54] METHOD OF MANUFACTURING AND INTERLOCKING JEWELRY WITH PRECISE PREFORMS

[75] Inventor: Shigeru Jhono, Los Angeles, Calif.

[73] Assignee: Tempo G, Los Angeles, Calif.

[21] Appl. No.: 146,488

[22] Filed: May 5, 1980

[51] Int. Cl.[3] ..... B22C 9/04

[52] U.S. Cl. ..... 29/423; 29/453; 164/35; 164/45; 264/221

[58] Field of Search ..... 164/34, 35, 36, 45, 164/9, 29; 264/221, 227; 29/423, 453

[56] References Cited

U.S. PATENT DOCUMENTS 2,354,026 7/1944 Jungerson ..... 164/35

FOREIGN PATENT DOCUMENTS 1036068 7/1966 United Kingdom ..... 264/221

*Primary Examiner*—Robert D. Baldwin

*Attorney, Agent, or Firm*—Vernon D. Beehler; Thomas I. Rozsa

[57] ABSTRACT

A method of casting metal so that the finished casting will hold a precise dimension in certain critical areas in order to enable the finished casting to be used as a frame for objects such as coins and medallions which are die struck to precise dimensions. Means of and apparatus for rigidly maintaining the object inside the cast frame by inexpensive means which will not damage the object and which will allow the object to be easily removed from the frame if necessary.

18 Claims, 19 Drawing Figures

METHOD OF MANUFACTURING AND INTERLOCKING JEWELRY WITH PRECISE PREFORMS

BACKGROUND OF THE INVENTION

Centrifugal casting of jewelry is a development and refinement of the very old lost-wax method of casting. The lost-wax process was used by the ancient Greeks and Chinese over two thousand years ago. In the 1930's the manufacturing jewelers in the United States discovered that they could use the lost-wax process for casting jewelery. This was made possible through the development of a means for rapidly duplicating a jewelry model in wax by means of a rubber mold.

To make duplicate wax patterns for lost-wax casting, a mold of the original metal model is needed. Rubber molds are used extensively by jewelry manufacturers for the mass production of jewelry because of the flexible and elastic nature of the rubber mold and because rubber molds can be used for many years to make thousands of intricate patterns.

The process of manufacturing the rubber mold is well known in the art. An aluminum mold frame is used, into which is placed unvulcanized rubber. The model from which a rubber mold is to be made can be brass, copper, silver, gold, platinum or any firm material with a melting point of approximately 150° F. or more above the vulcanizing temperature (310° F.) of the uncured rubber. A sprue rod, used to provide the hole in the rubber mold through which wax will be injected, is then soldered to the model. The model is placed inside the aluminum frame and packed with rubber by conventional means. The rubber is then vulcanized in the mold by a commercial electric vulcanizer. When the uncured rubber has been vulcanized, the entire frame is cooled and then the rubber mold is removed from the frame. The rubber mold is then cut in half at least a sufficient amount to enable the model to be removed and the rubber can also be cut by conventional and well known means to create an intricate design mold.

It is well known in the prior art to inject casting wax into the rubber mold by means of a wax injector or a centrifugal machine in order to obtain a wax pattern replica of the model. After the wax has been injected into the rubber mold, it is allowed to set for 2–3 minutes and then carefully removed.

The resulting wax pattern replica, when fully cooled, will be approximately 10 to 15 percent smaller than the original model made from metal. This variation in size is caused by a combination of factors: (1) the elasticity of the mold rubber itself which is packed and vulcanized under heat and pressure and then expands to an unpredictable and variable degree in all dimensions to fill the cavity when the original metal model is cut away and removed from the rubber to create the mold; (2) variations in mold clamping pressure and exactness of registration of mold parts, coupled with the differences in temperature and pressure at which the wax is repeatedly injected into the mold to form multiple wax patterns for production; (3) shrinkage of the wax itself during cooling; (4) distortion of the wax during handling to remove the wax pattern from the rubber mold. While it is possible to make the model oversize in order to partially compensate for shrinkage, it is impossible to produce a finished wax pattern which is absolutely precise when compared to the original metal model because of the unpredictability of these various factors.

A group of wax patterns can then be assembled on a master wax sprue to form a tree which can be surrounded with investment in order to form the final mold for casting metal such as gold. The investment can be a combination of plaster of paris and quartz, or it can be composed of cristobalite, gypsum, silicas, and modifying agents. The investment must possess the power to withstand the required high temperature to remove the wax and the higher temperature and pressure of the molten metal without cracking. The investment is prepared by traditional and well known methods and is placed in a bell jar and vacuumed to remove trapped air from the investment. The wax pattern tree is then surrounded with the investment. Wax is then eliminated (burned out) by heating the object in a furnace at 1300° to 1400° F.

Metal such as gold is then injected into the cavities formed in the investment when the wax patterns were burned out by well known centrifugal casting means. In one such method, a flask containing the formed investment is placed on the end of one arm of the machine and the nozzle of the crucible which holds the molten gold is placed into the sprue opening of the flask and the investment. The other end of the machine's arm has adjustable weights to balance the arm. The arm is rotated by use of an electric motor in order to develop the necessary centrifugal force which is outward or away from the center, and this force injects the molten gold into the investment cavity. All the gold in the crucible enters the flask on the first rotation, and the arm continues to spin so that the metal remains in the flask until it solidifies. After the gold has been cast, the flask is removed from the centrifugal casting machine and is permitted to cool.

The resulting casting will be approximately one percent (1%) dimensionally smaller than the wax pattern used to form the investment capacity. This is due to the combined factors of shrinkage of the investment compound and shrinkage during the solidification of the metal cast. Then the investment is broken away and the gold casting is finished and polished by conventional means.

While the above described method of centrifugal casting provides finished products of substantial beauty, the method does not permit the casting to be made within uniformly precise tolerances. In the manufacture of most items of jewelry, such exact precision is not required. However, if an item of jewelry is to be matched with a second item which has been stamped or die struck to exact measurements, the conventional method of lost wax centrifugal casting is inadequate. As discussed above, this is primarily due to the reduction in size of the wax pattern replica which cannot be precisely controlled by conventional means known in the above described prior art and in addition due to the shrinkage of the investment and the metal being cast.

SUMMARY OF THE INVENTION

The present invention relates in general to a method of casting metal such as gold so that the finished casting will hold precise dimensions in certain areas. By using the method of the present invention to cast the piece, the finished casting can be used as a frame for objects such as coins and medallions which are die struck to precise dimensions. The present invention relates to a method of forming the rubber mold to create wax patterns of precise dimensions in critical areas. The present invention also relates to a method of producing a wax pattern so that required precise predetermined dimensions are maintained in the wax pattern after removal from the rubber mold. The present invention also relates to a method of firmly maintaining an object inside the finished cast frame by use of a spring ring or multiple retainers placed in a groove located directly beneath the object and whose walls are approximately at 45° to the horizontal so that half the force of the spring ring is directed to maintaining the object in the cast frame and half the force of the spring ring is directed to maintaining the spring ring inside the groove.

More particularly, in forming a rubber mold for use in the art of lost wax casting, it has been discovered according to the present invention that if a metal form key approximately one percent (1%) larger than the precise dimensions of an object which shall be framed inside a final cast piece is placed in the area of a casting model at the locations where the precise dimensions in the final cast piece are required, and is maintained in that position when the casting model is surrounded by a material of yieldable consistency such as rubber, while the rubber is vulcanized, the resulting rubber mold contains a controllably precise cavity located where the precise dimensions are required.

It has also been discovered, according to the present invention that if the metal form key approximately one percent larger then the precise dimensions of an object which shall be framed inside a final cast piece is left inside the rubber mold when wax is injected into the rubber mold and then allowed to remain inside the surrounding wax pattern during removal of the wax from the mold and subsequent cooling, the wax pattern will contain the precise dimensions required to enable a final casting to be formed which will be a precision frame for the object.

It has also been discovered according to the present invention, that if the metal form key is chamfered at an exposed perimeter such as its lower external edge, the space created by the chamfer allows the rubber mold to be formed more perfectly at its critical junctions and also allows the wax pattern which will be formed surrounding the metal form key to also be more perfectly formed at its critical junctures.

It has also been discovered, according to the present invention, that if a groove is cast into the inner wall of the cast piece which will act as a frame for an object, in the area directly underneath the section in which the object will be mounted and the groove is cast so that its walls form an angle of approximately 45° to the horizontal or substantially an included angle of 90° overall, then a locking means such as a spring ring may be inserted in the groove and the resolution of forces of said ring are about equally vectored such that half the force will be directed to maintaining the object in the cast frame and half the force will be directed to maintaining the spring ring inside the groove thereby forming an ideal means for securing and maintaining the object inside the cast piece. This securing means does not damage the object in any way and also allows the object to be easily removed by merely removing the locking ring.

It is therefore an object of the present invention to provide a method of casting metal so that the finished casting will have precise dimensions in certain critical areas.

It is a further object of the present invention to provide a method of forming a rubber mold to create wax patterns of precise dimensions in certain critical areas.

It is still another object of the present invention to provide a method of producing wax patterns so that they maintain predetermined critical dimensions while allowing other non-critical portions of the wax pattern to shrink in a conventional manner.

It is still another object of the present invention to create a means of and an apparatus for securely maintaining a precisely formed object inside the cast frame by inexpensive means which will not damage the object and which will allow the object to be easily removed from the frame if necessary.

Further novel features and other objects of the present invention will become apparent from the following detailed description and the appended claims taken in conjunction with the drawings.

DRAWING SUMMARY

Referring particularly to the drawings for the purposes of illustration only and not limitation there is illustrated:

DETAILED DESCRIPTION OF THE PREFERRED EMBODIMENT

The present invention relates in general to a method of casting metal such as gold so that the finished casting will hold precise dimensions in certain critical areas. By using the method of the present invention to cast the piece, the finished casting can be used as a frame for objects such as coins and medallions which are die struck to precise dimensions. The present invention also relates to a method of and apparatus for efficiently retaining the object inside the cast piece so that the object is not damaged and so that the object can be easily removed from the frame if required.

Figure 1:
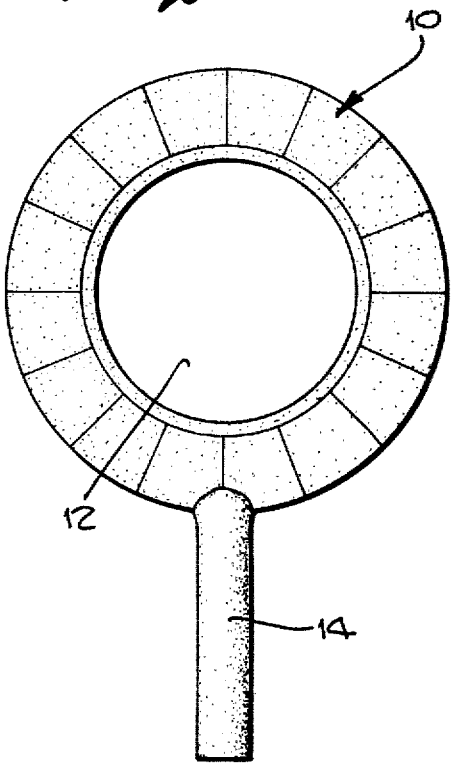
FIG. 1 is a top plan view of the original wax model from which the original metal casting model is made.

With reference to the drawings of the invention in detail and more particularly to FIG. 1, there is shown at 10 the original hand carved wax model from which the original metal model is made. The original wax model 10 has a cavity 12 in its center. An elongated piece 14 at one end is designed with the original hand carved wax model 10 in order to provide an opening or sprue through which the molten metal will be poured when the original metal model is cast. The original wax model 10 is oversized by 10% to 15% on its outer dimensions from the final desired size of the metal model to compensate for shrinkage, but the critical inner dimensions to be maintained is of the desired final size.

The original wax model 10 is then surrounded with investment in order to form the mold for the original metal model. The investment used is a standard investment compound which can be composed of cristobalite, gypsum, silicas, and modifying agents. The investment is prepared by traditional and well known methods. After the original wax model 10 is surrounded by the investment, the combination is placed in a bell jar and vacuumed to remove trapped air in the investment. The original wax model 10 is then burned out of the investment by heating the investment in a furnace at 1300° F. to 1400° F. The cavity left by the burned out wax forms the mold for casting the original metal model. The metal for the original casting model can be one of several metals such as brass, silver, or gold. For purposes of the present invention, it has been discovered that sterling silver is the best metal to use for casting the original metal model. The silver is heated until it is in its molten state and is then injected into the cavitites formed in the investment by well known centrifugal casting means which will be described in detail later.

After cooling, the investment is broken away and the raw sterling silver casting remains. The original wax model 10 is so designed that the investment mold will form a silver casting in which the inner dimension is undersized and the outer dimension is oversized. In this way, silver can be machined away in the inner surface to have the inner surface be one percent (1%) larger than the precise dimensions of the object. These inner dimensions are critical because they must conform to the exact dimensions of the machined or die struck piece (object) for which the end product production castings will act as a frame. The outer dimensions are not critical and may be left slightly oversized to compensate for normal uncontrolled shrinkage without compromising design. The silver casting is then machined and detailed to create the exact original metal model desired for making the rubber mold from which multiple wax patterns for casting will be made.

Figure 2:
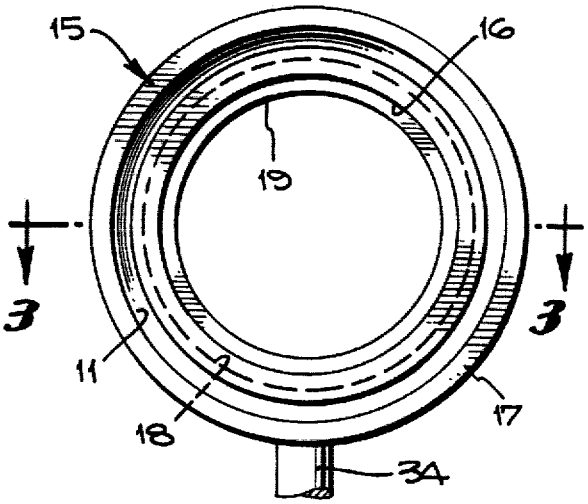
FIG. 2 is a bottom plan view of the completed original metal casting model.
Figure 3:
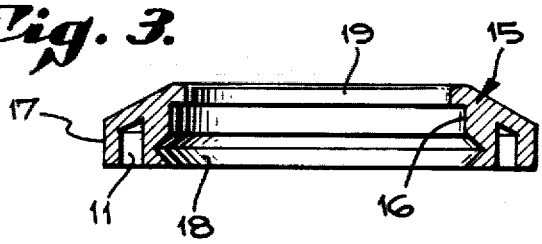
FIG. 3 is a cross-sectional view of the completed original metal model, taken on the line 3—3 of FIG. 2.

The completed original metal model is shown in FIGS. 2 and 3. In addition to machining the top portion of the inner wall 16 of the silver casting 15 to one percent larger than the precise dimensions of the die struck piece (object) as described above, the inner surface of the silver casting 15 is cast and machined to have a channel 18 which runs the entire circumference of the inner wall of the silver casting 15. The channel 18 is located directly below the precisely machined portion of the inner wall 16. For reason which will be described later, it is preferred that the angle of the channel be approximately 45° from the horizontal, and approximately 90° in total as shown in FIG. 3. This channel 18 is cast into the silver model and then is machined to precise dimensions. A cavity 11 is also formed between the inner wall 16 and outer wall 17 of the original metal casting model. The model is also cast with a central cavity 19.

Figure 4:
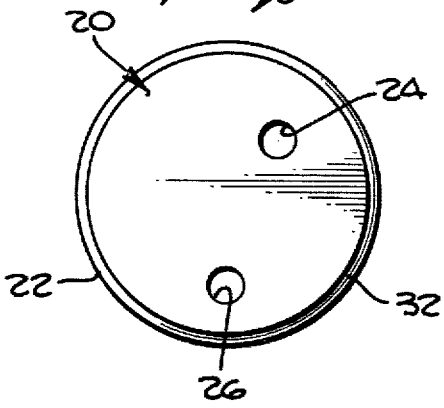
FIG. 4 is a bottom plan view of the model form key which is used to hold precise dimensions in the area where precise dimensions are required.

A significant element of the present invention is the use of the model form key 20 shown in FIG. 4. The model form key 20 is one percent (1%) dimensionally larger in the planar areas than the coin or medallion for which the finished cast piece will act as a frame. The thickness of the model form key 20 is slightly thicker than the thickness of the coin or medallion to assist in casting the channel 18.

The circumference 22 of the model form key 20 is matched to fit into the top portion of the inner wall 16 of the completed original metal model 15. The thickness of the major section of the model form key 20 and the top portion of the inner wall 16 are also matched to the exact dimensions of the coin or medallion for which the final cast piece will be used. The lower portion of the model form key 20 is chamfered and extends slightly into the lower portion of the central cavity 19, as can be seen from the cross-sectional view of FIG. 6. For purposes of the present invention, the model form key 20 is made of brass and is machined to precise dimensions. Means of indexing this model form key 20 into the planned rubber mold is provided by offset holes 24 and 26 as shown in FIG. 4. The holes are precision jig drilled into the model form key 20 during fabrication. The indexing means can also be performed through an assymetrical raised surface on the model form key to create a precise locater.

Figure 5:
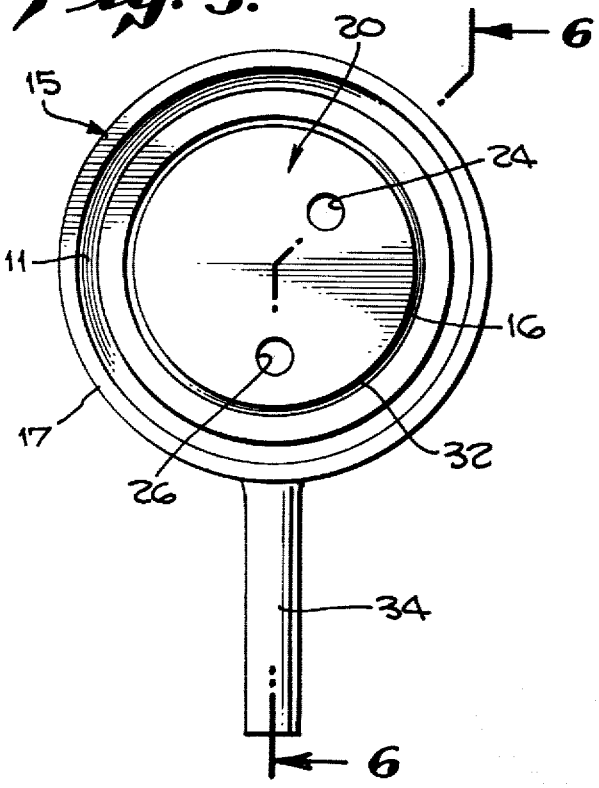
FIG. 5 is a bottom plan view of the completed original metal model with model form key soldered in place.
Figure 6:
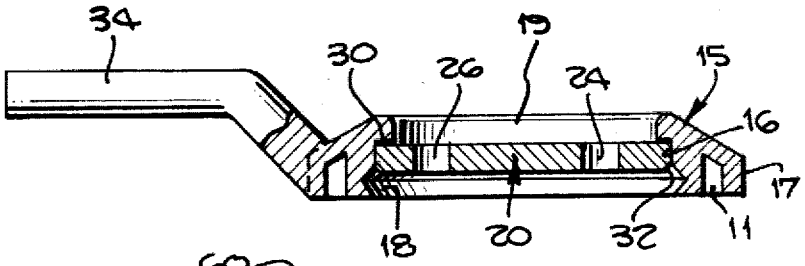
FIG. 6 is a cross-section view taken along line 6—6 of FIG. 5 of the completed original metal model with the model form key soldered in place and illustrating the approximate 45° groove in the area of the original casting model inner wall beneath the model form key.

The model form key 20 is then placed in the center of the original metal model 15 and is soldered in place. This is shown in the bottom plan view of FIG. 5 and the cross-sectional view of FIG. 6. The solder is shown at 30 in FIG. 6. Soldering is done around the entire perimeter of the upper surface and inner upper wall to be certain that during the vulcanizing of the rubber mold, rubber will not seep in on the side of the model form key 20 between it and the inner upper wall 16 of the original metal model 15, thereby creating a distorted mold cavity. The cross-sectional view shown in FIG. 6 shows that the model form key 20 is chamfered on its lower surface and extends into the lower portion of the central cavity 19. The chamfer is shown at 32, and its purpose will be explained later. The final step before creating the rubber mold is to attach a metal sprue rod 34 to the edge of the original metal model 15 as shown in FIG. 5. In some configurations, multiple sprue rods may be required to assure a proper fill of the investment cavity when the metal is cast.

The general process of manufacturing the rubber mold is well known in the art. An aluminum mold frame is used, into which is placed unvulcanized rubber. For purposes of the present invention, standard uncured rubber in ⅛ inch thick sheets is used. Rubber is placed in the bottom of the frame, the original metal model 15 with model form key 20 is soldered in place and metal sprue rod 34 attached is placed in the center over the bottom rubber sheets and then surrounded with additional rubber sheets on the sides and top. The purpose of the sprue rod 34 is to provide a passage in the rubber mold through which wax may be injected. The rubber is then vulcanized in the mold by a commercial electric vulcanizer. For the present invention, this is done at 350° F. for 25 minutes. The entire frame with rubber inside it is then allowed to cool at room temperature. The rubber mold must cool inside the frame or else the rubber mold will become distorted. After sufficient cooling, the rubber mold, usually rectangular in shape, is cut in half along its lateral lengthwise portion. When cutting the rubber mold, it is cut almost the entire length, with just a small portion remaining uncut on one edge so the two segments will be hinged together. An irregular pattern is cut in the rubber mold with a surgical type knife, so the two mold segments can be registered together when clamped.

Figure 7:
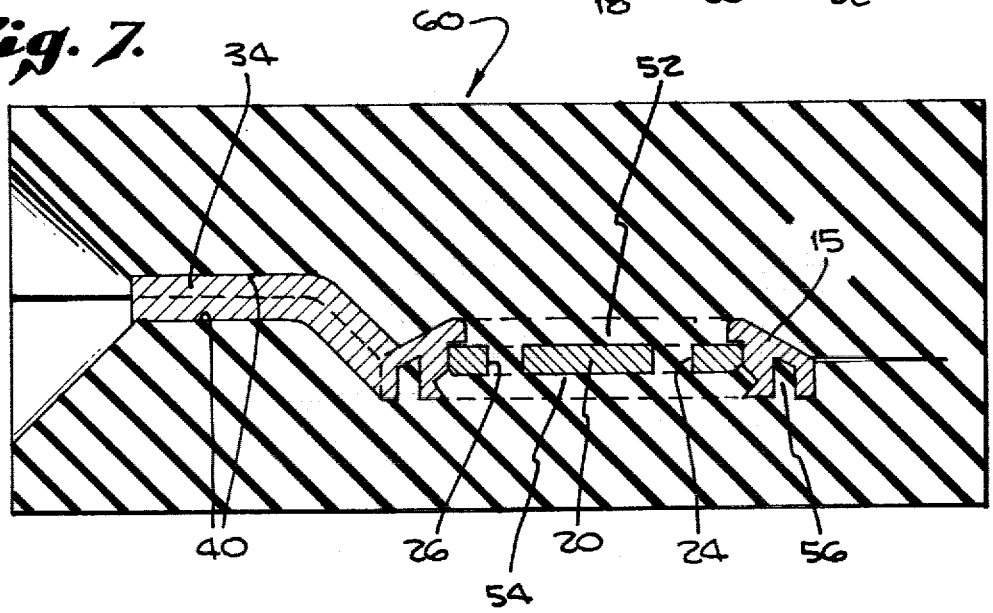
FIG. 7 is a cross-sectional view of the rubber mold formed around the completed original metal model shown in FIG. 6, with rubber mold cut in half along its lateral lengthwise direction.
Figure 8:
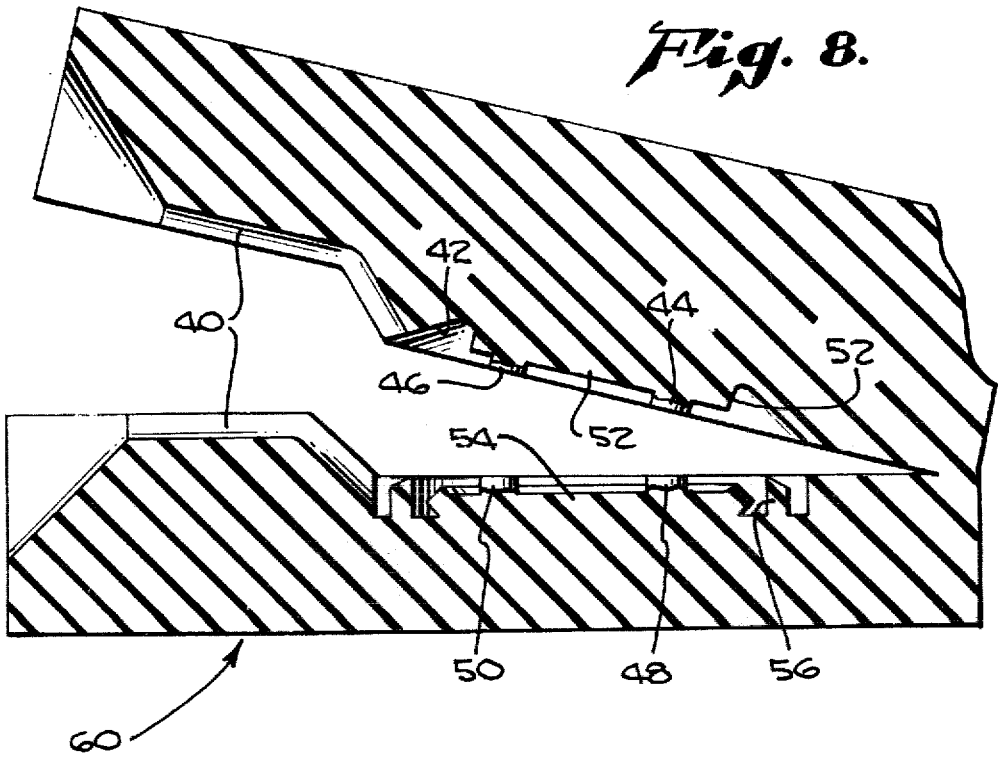
FIG. 8 is a cross-sectional view of the completed rubber mold in its opened state, with original metal model removed and showing cavities in the mold.

A cross-sectional view of the rubber mold formed around the completed original casting model is shown in FIG. 7. A cross-sectional view of the completed rubber mold in its opened state with original casting model 15 removed is shown in FIG. 8. The cavity formed by the metal sprue rod 34 is shown at 40. The upper embossed portion of the mold is shown at 44 and 46 in the upper half of the rubber mold 60 and at 48 and 50 in the lower half of the rubber mold. The raised area in the center of the rubber mold 60 which is formed by the model form key 20 is shown at 52 and 54. Also shown in the rubber mold 60 is the raised portion 56 which serves to cast the inner wall 16 and channel 18 in the final wax model as well as the outer wall in the final wax model. The critical dimension we are concerned with is the circumference of the raised area in the rubber mold, 52 and 54. Because of the model form key 20, the circumference of this raised area can be precisely maintained to obtain the circumference needed to match the die struck object for which the final production casting will act as a frame.

After the rubber mold has been cut as described above and the original metal model removed, the cavity in the rubber mold shrinks by approximately 10% due to the elasticity of the rubber compound. As a result, the dimensions of the outer wall of the finished production casting will be smaller than the original metal model 15 because the rubber mold 60 contracts. Thus, if the dimensions of the inner wall are maintained by use of a model form key 20, the outer wall of the casting would be somewhat thinner than desired. This can be partially compensated for by making the outer dimension of the original metal model 15 about 10% oversize so that after the shrinkage, it will be approximately the desired size. It is impossible to accurately predict the precise shrinkage because variations in cooking time and temperature or characteristics of rubber vary. To be certain that the critical inner dimensions described above are maintained, a model form key 20 which is a duplicate of the one soldered into the original metal model 15 is placed between the surfaces 52 and 54 while wax patterns are made for production castings. the duplicate of the model form key 20 is held in place by indexing means 44, 46, 48, and 50. In this way, the critical inner dimensions are kept exact in the rubber mold. The outside dimensions of the casting is not critical.

Figure 9:
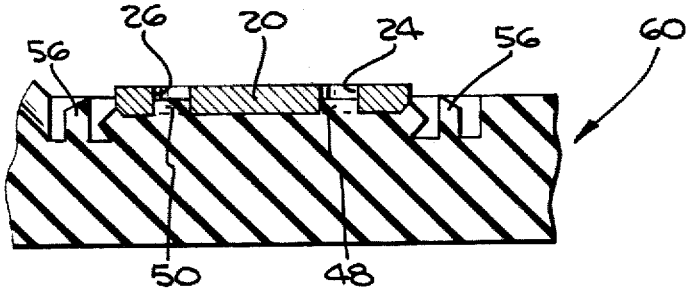
FIG. 9 is a fragmentary cross-sectional view of the lower portion of the rubber mold showing model form key placed inside the rubber mold and held in place by indexing means.
Figure 10:
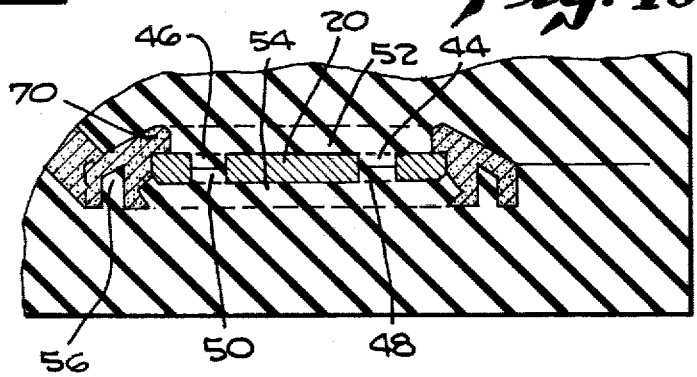
FIG. 10 is a fragmentary cross-sectional view of the closed rubber mold with wax injected therein.

With reference once again to FIG. 6, it will be recalled that an exposed perimeter such as the lower portion of model form key 20 is chamfered, shown at 32. One of the reasons for this chamfering is to allow an outlet for the rubber to flow after it has settled in the groove 18. If the edge were straight and not chamfered, there would be a bottleneck and the groove 18 would be distorted and would not be formed at a near perfect 45° angle to the horizontal. It would also create a point of weakness which could cause problems in later wax patterns. After the rubber mold 60 has been vulcanized, cut and the original metal model removed as previously described, one is ready to begin the casting of multiple wax models. A critical point in the process is to leave the duplicate model form key 20 in its place in the rubber mold 60 while injecting wax into the mold in order to maintain critical inner dimensions in the mold cavity. A fragmentary cross-sectional view of the lower portion of the rubber mold 60 showing model form key 20 placed inside the rubber mold and held in place by indexing means 48 and 50 is shown in FIG. 9. Casting wax is injected into the rubber mold by means of a wax injector by methods well known in the prior art. The wax pattern 70 is obtained with the model form key 20 in the central portion of the wax pattern 70. This is shown in the fragmentary cross-sectional view of the closed rubber mold with wax injected therein, shown in FIG. 10. A second purpose of the chamfer 32 in the model form key 20 is to provide an area for the wax to flow out of the channel 18 so there is a smooth wax pattern. Without the model form key 20 remaining in the mold during the wax injection and subsequent cooling process, the wax pattern in the critical dimension areas will be smaller than desired due to the elasticity and resultant shrinkage of the rubber mold cavity combined with shrinkage of the wax itself. It has been established that in a circular wax model replica as described above, the diameter of the critical dimension will be 2.76% undersize if the model form key 20 is not used. Further, the model form key 20 conforms the rubber mold cavity in the critical areas to the precise dimensions of the original metal model. For purposes of the present invention, casting wax is injected into the rubber mold under a pressure of 10 to 15 PSI and at a wax temperature of 250° F. After casting, the wax is allowed to cool for 2 to 3 minutes until it is hardened.

Figure 11:
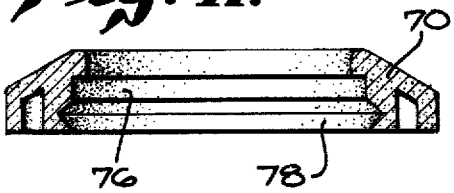
FIG. 11 is a cross-sectional view of the finished wax pattern with model form key removed.

After the wax pattern 70 has hardened, the model form key 20 is removed. A cross section of the wax pattern 70 is shown in FIG. 11. The flat area where the model form key 20 was located is shown at 76, and the channel groove area directly below it is shown at 78. At this point, a standard casting procedure is followed. The wax pattern is surrounded with investment in order to form the final mold for the metal such as gold. The investment must withstand the required high temperature to remove the wax and the higher temperature and pressure of the molten metal without cracking. The investment can be a combination of plaster of paris and quartz, or it can be composed of critobalite, gypsum, silicas, and modifying agents. The investment is prepared by traditional and well known methods and is placed in a bell jar and vacuumed to remove trapped air in the investment. The wax pattern 70 is then surrounded with investment. In practice, multiple wax patterns are generally attached to a central wax sprue prior to investment. The wax is then eliminated (burned out) by heating the object in a furnace at 1300° F. to 1400° F.

Well known centrifugal casting means is used to inject the metal such as gold into the cavities formed in the investment when the wax pattern 70 is burned out. In one such method, a flask containing the formed investment is placed on the end of one arm of the casting machine and the nozzle of the crucible which holds the molten gold is placed into the sprue opening of the investment within the flask. The other end of the machine's arm has adjustable weights to balance the arm. The arm is rotated by use of an electric motor in order to develop the necessary centrifugal force, and this force injects the molten gold into the investment. All the gold in the crucible enters the flask on the first rotation, and the arm continues to spin so that the metal remains in the flask until it solidifies. After the gold has been cast, the flask is removed from the centrifugal casting machine and is permitted to cool. During the combined processes of forming the investment, burning out the wax pattern 70, injecting molten gold into the investment and the subsequent cooling of the gold, the dimensions of the final cast piece shrink by a total of one percent (1%) from the size of the wax pattern 70. This is the reason the model form key 20 was made one percent (1%) dimensionally larger in the planar areas than the coin or medallion for which the finished cast piece will act as a frame. The one percent (1%) increase in size compensates for the one percent (1%) shrinkage during these final casting processes. Then the investment is broken away and the gold castings are finished and polished by conventional means. The final cast piece has a perfectly formed inner dimension which exactly corresponds to the size of the coin or medallion for which it was designed to act as a frame.

Figure 12:
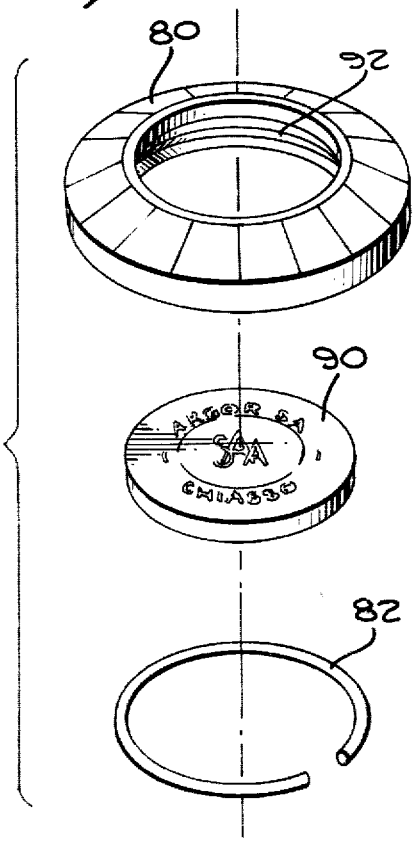
FIG. 12 is an exploded perspective view of the completed product showing the three elements from a top elevational view.
Figure 13:
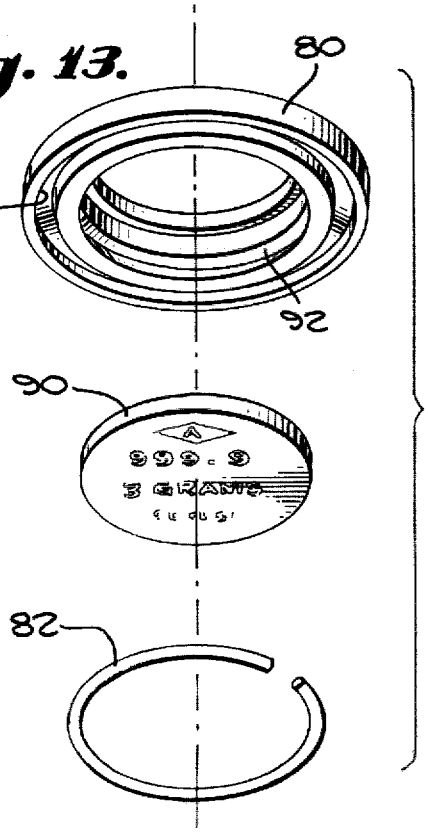
FIG. 13 is an exploded perspective view of the completed product showing the three elements from a bottom elevational view.

The three components of the completed product are shown in the exploded perspective views of FIGS. 12 and 13. FIG. 12 is a top elevational view and FIG. 13 is a bottom elevational view. The three components of the completed product are the gold cast frame 80; the medallion or object 90 for which the casting has been made (in this example of 3 gram 24 karat circular gold piece); and a spring gold wire or ring, designated as 82.

Figure 14:
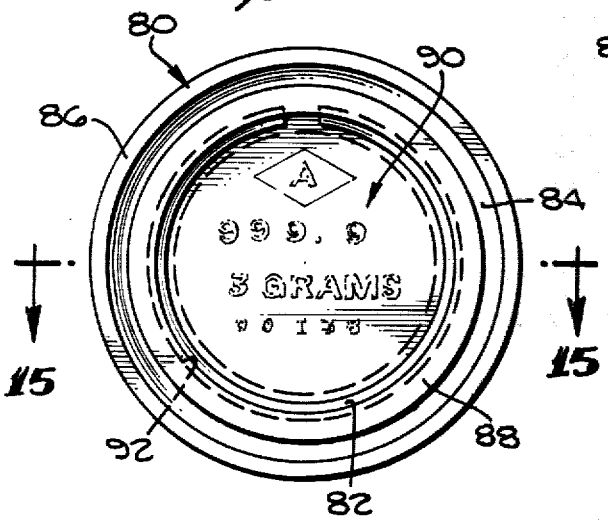
FIG. 14 is a bottom plan view of the completed product with coin or medallion inserted and supported in place by a spring gold ring.
Figure 15:
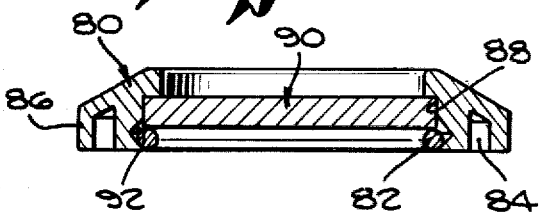
FIG. 15 is a cross-sectional view of the completed product described in FIG. 14, taken along line 15—15 of FIG. 14.
Figure 16:
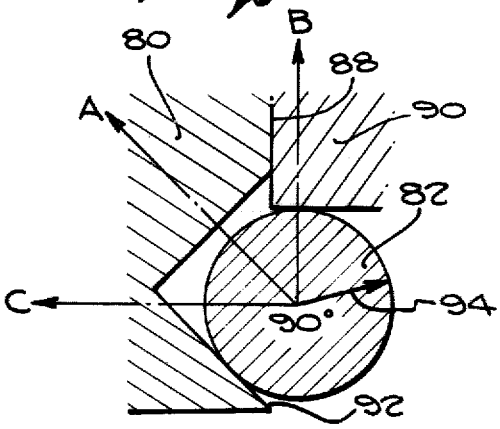
FIG. 16 is a resolution of forces diagram of the spring gold wire or ring.

The bottom portion of the assembled unit is shown in FIG. 14 and a cross-sectional view of the completed unit is shown in FIG. 15. As can be readily observed from both figures, the medallion is perfectly fit into the critical area of the frame, i.e., the critical dimension inner wall 88. The outer wall is shown at 86 and the cavity between the walls is shown at 84. There is no room for the medallion to move around or "swim" inside the setting and there was no requirement to modify the medallion to fit inside the frame. The spring gold wire 82 fits into the groove 92 which was cast into the inner wall. The top edge of the spring gold wire 82 fits flush against the bottom portion of the medallion 90, and the radius 94 of the spring gold wire 82 is almost equal to the radius of the groove 92. The reason the spring gold wire 82 is able to support the heavier medallion in place is shown in the resolution of forces diagram in FIG. 16. The centrifugal force vector of the wire is shown in A. Because the angle of the groove 92 is substantially 45°, a resolution of the centrifugal force vector into vertical component B and a horizontal component C shows half the total centrifugal force A generates an upward vector B to keep the medallion in place while half the centrifugal force A generates a sideways vector C to keep the spring gold wire 82 inside the groove 92.

Figure 17:
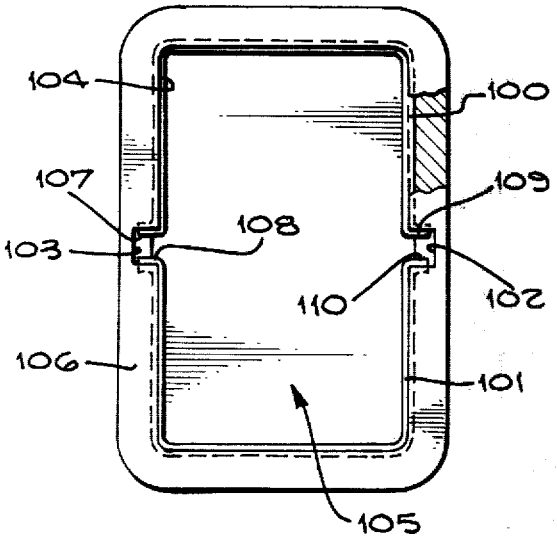
FIG. 17 is a bottom plan view of a completed product in a rectangular configuration, with coin or medallion inserted and supported in place by two spring gold retainers.
Figure 18:
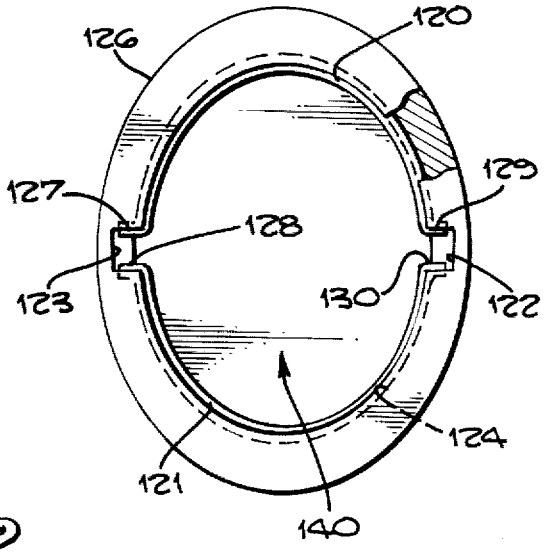
FIG. 18 is a bottom plan view of a completed product in an oval configuration with coin or medallion inserted and supported in place by two spring gold retainers.
Figure 19:
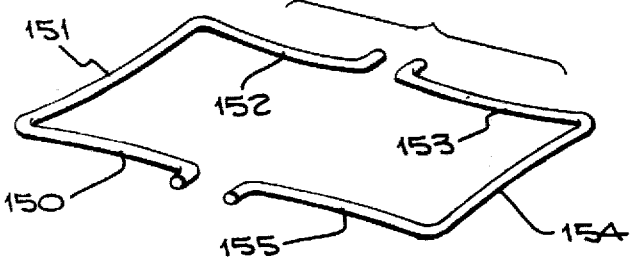
FIG. 19 shows the prestressed configuration of the two rectangular spring gold retainers shown in FIG. 17 wherein both retainers are identical in form.

The present invention has been described utilizing a circular mold for a circular medallion, but this in no way is intended to limit the scope of the invention. The present invention can be used with multiple other configurations such as rectangular or oval. When this is done, it is usually preferable to have the supporting spring gold wire in 2 pieces with teeth at the edge that fit into a slotted hole in the inner wall of the frame. This is shown in FIGS. 17 and 18 which are bottom views of the completed frame, medallion and spring gold wire in a rectangular and oval configuration respectively. With reference to FIG. 17, the rectangular shaped medallion is shown at 105, and surrounded by the critical dimension inner wall 104 and outer wall 106 of the frame. The spring gold wire is shown in two pieces, 100 and 101, with teeth 107 and 108 and teeth 109 ad 110 which fit into slotted holes 103 and 102 respectively in the inner wall 104. In the oval configuration shown in FIG. 18, the oval shaped medallion is shown at 140 and surrounded by the critical dimension inner wall 124 and outer wall 126 of the frame. The spring gold wire is shown in two pieces, 120 and 121, with teeth 127 and 128, and teeth 129 and 130 which fit into slotted holes 123 and 122 respectively in the inner wall 124. When using a rectangular shaped wire, it is necessary to prestress the wire as shown in FIG. 19 in order to have it be flush inside the rectangular shaped groove. The wire is bent in each lengthwise section, as shown at 150, 151, 152, 153, 154, and 155.

One type of metal for which the frame can be made is 24 karat gold. The coins or medallions can also be 24 karat gold coins or medallions such as those manufactured by Swiss banks. Valuable coins or objects of art can also be used for the centerpieces. In the past, conventional cast mountings or frames do not match the dimension of the coin or medallion with precision. When the coin, object of art, or medallion is therefore forced into an imperfect frame, the coin, object of art or medallion can be scratched or dented. This may substantially diminish the value of the item. If the frame is too large, the object swims inside the frame and this also lessens the value of the entire piece. By using the present method of manufacturing the frame for the coin, object of art or medallion, a perfect fit can be achieved quickly and repeatedly in production, without damage to the coin, object of art or medallion. The apparatus and method of retaining the object in place enables the object to be firmly held without damage to lessen its value while at the same time allowing it to be easily removed. The finished jewelry product can be worn as a pendant on a chain around one's neck, on a bracelet or wristband, in a ring, or in numerous other configurations.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the methods shown are intended only for illustration and for disclosure of an operative embodiment and not to show all of the various forms of modification in which the invention might be embodied.

The invention has been described in considerable detail by providing a disclosure of at least one of its forms. However, such detailed description is not intended in any way to limit the broad features or principles of the invention, or the scope of patent monopoly to be granted.

What is claimed is:

1. In the art of casting metal so that the finished casting will hold precise dimensions in certain critical areas to enable the finished casting to be used as a frame for encasing an object of precise dimensions, the method of making the frame metal casting comprising the steps of:

a. selecting an object to be encased in a metal frame;
b. selecting an original casting model containing a cavity disposed therein;
c. forming an interior portion of the inner wall adjacent said cavity of said casting model to dimensions which are one percent larger than the dimensions of said object to be encased.
d. selecting a model form key whose dimensions are one percent larger than said object to be encased;
e. placing said model form key in said cavity of said casting model and rigidly attaching said model form key to said inner wall of said casting model;
f. attaching the end of a rod to a portion of said casting model;
g. placing said casting model with said rod and said model form key attached into a mold, surrounding said casting model and attachments with a material of yieldable consistency and solidifying said material in the form of a completed first stage mold;
h. separating said first stage mold into opposite complementary portions and allowing one section to remain intact so that the two complementary portions can be fit together precisely;
i. removing said casting model and attachment and placing a duplicate model form key in the area of said first stage mold where said model form key was located inside said casting model;
j. closing both portions of said first stage mold with said duplicate model form key inside and injecting casting wax into said first stage mold so that the wax surrounds said duplicate model form key and forms a wax pattern inside said first stage mold;
k. removing said wax pattern from said first stage mold;
l. then removing said duplicate model form key from said wax pattern and surrounding said wax pattern with casting investment compound;
m. extracting the material of said wax pattern to leave a formed investment;
n. casting molten metal in said formed investment to form a finished casting to be used as the frame for said object.

2. In the art of casting metal so that the finished casting will hold a precise dimension in certain critical areas to enable the finished casting to be used as a frame for encasing an object of precise dimensions, the method of making the frame metal casting comprising the steps of:

a. selecting an object to be encased in a metal frame;
b. selecting an original casting model containing a centrally disposed cavity;
c. forming an interior portion of the inner wall adjacent said centrally disposed cavity of said casting model to dimensions which are one percent larger than the dimensions of said object to be encased.
d. selecting a model form key whose dimensions are one percent larger than said object to be encased;
e. placing said model form key in said centrally disposed cavity of said casting model and rigidly attaching said model form key to said inner wall of said casting model;
f. attaching a rod to an external edge portion of said casting model;
g. placing said casting model with said rod and said model form key attached into a mold, surrounding said casting model and attachments with a material of yieldable consistency and solidifying said material in the form of a completed first stage mold;
h. separating said first stage mold into opposite complementary portions and allowing one section to remain intact so that the two complementary portions can be fit together precisely;
i. removing said casting model and attachments and placing a duplicate model form key in the area of said first stage mold where said model form key was located inside said casting model;
j. closing both portions of said first stage mold with said duplicate model form key inside and injecting casting wax into said first stage mold so that the wax surrounds said duplicate model form key and forms a wax pattern inside said first stage mold;
k. removing said wax pattern from said first stage mold and allowing said wax pattern to cool while said duplicate model form key remains inside said wax pattern;
l. then removing said duplicate model form key from said wax pattern and surrounding said wax pattern with casting investment compound;
m. extracting the material of said wax pattern to leave a formed investment;
n. casting molten metal into said formed investment to form a finished casting to be used as the frame for said object.

3. In the art of casting metal so that the finished casting will hold a precise dimension in certain critical areas to enable the finished casting to be used as a frame for encasing an object of precise dimensions, the method of making the frame metal casting comprising the steps of:

a. selecting an object to be encased in a metal frame;
b. selecting an original casting model containing a centrally disposed cavity;
c. forming an interior portion of the upper inner wall adjacent said centrally disposed cavity of said casting model to dimensions which are one percent larger than the dimensions of said object to be encased;
d. forming a transversely extending channel, the wall portion of which subtends an angle of substantially 90° into the circumference of said inner wall of said casting model, and at a location immediately adjacent said upper portion of said inner wall;
e. selecting a model form key whose dimensions are one percent larger than said object to be encased;
f. chamfering an exposed perimeter of said model form key;
g. placing indexing means in said model form key;
h. placing said model form key in said centrally disposed cavity of said casting model and rigidly attaching said model form key to said inner wall of said casting model;

i. attaching a rod to an external edge portion of said casting model;

j. placing said casting model with said rod and said model form key attached into a mold, surrounding said casting model and attachments with a material of yieldable consistency and solidifying said material in the form of a completed first stage mold;

k. separating said first stage mold into opposite complementary portions and allowing one section to remain intact so that the two complementary portions can be fit together precisely;

l. removing said casting model and attachments and placing a duplicate model form key including chamfered perimeter and indexing means in the area of said first stage mold where said model form key was located inside said casting model;

m. closing both portions of said first stage mold with said duplicate model form key inside and injecting casting wax into said first stage mold so that the wax surrounds said duplicate model form key and forms a wax pattern inside said first stage mold;

n. removing said wax pattern from said first stage mold and allowing said wax pattern to cool while said duplicate model form key remains inside said wax pattern;

o. then removing said duplicate model form key from said wax model and surrounding said wax pattern with casting investment compound;

p. extracting the material of said wax pattern to leave a formed investment;

q. casting molten metal into said formed investment to form a finished casting to be used as the frame for said object.

4. The method of making the frame metal casting as described in claim 3, including:

a. placing offset forms in said model form key to serve as indexing means;

b. placing said casting model with said rod and said model form key attached into a mold, surrounding said casting model and attachments with a material of rubber like consistency and solidifying said material in the form of a completed first stage mold.

5. The method of making the frame metal casting as described in claim 3, including:

a. selecting an object to be encased having an arcuate perimeter.

6. The method of making the frame metal casting as described in claim 3, including:

a. selecting an object to be encased having a straight sided perimeter.

7. The method of making the frame metal casting as described in claim 3, including:

a. finishing said casting by conventional means;

b. selecting a spring gold ring;

c. placing said object to be encased in the central cavity of said casting and in the upper machined portion area of said casting, and locking said object in place by placing said spring gold ring into said 90 degree angle channel.

8. The method of making the frame metal casting as described in claim 5, including:

a. finishing said casting by conventional means;

b. selecting multiple retaining members;

c. placing said object to be encased in the central cavity of said casting and in the upper machined portion area of said casting, and locking said object in place by placing said multiple retaining members into said 90 degree angle channel.

9. The method of making the frame metal casting as described in claim 5, including:

a. finishing said casting by conventional means;

b. selecting multiple retaining members;

c. placing said object to be encased in the central cavity of said casting and in the upper machined portion area of said casting, and locking said object in place by placing said multiple retaining members into said 90 degree angle channel.

10. In the art of casting metal so that the finished casting will hold a precise dimension in certain critical areas to enable the finished casting to be used as a frame for encasing an object of precise dimensions, the method of making the frame metal casting comprising the steps of:

a. selecting an object to be encased in a metal frame;

b. selecting an original casting model containing a centrally disposed cavity;

c. forming an interior portion of the inner wall adjacent said centrally disposed cavity of said casting model to dimensions which are substantially one percent larger than the dimensions of said object to be encased.

d. selecting a model form key whose dimensions are substantially one percent larger than said object to be encased;

e. placing said model form key in said centrally disposed cavity of said casting model and rigidly attaching said model form key to said inner wall of said casting model;

f. attaching a rod to an external edge portion of said casting model;

g. placing said casting model with said rod and said model form key attached into a mold, surrounding said casting model and attachments with a material of yieldable consistency and solidifying said material in the form of a completed first stage mold;

h. separating said first stage mold into opposite complementary portions and allowing a section of one edge to remain intact so that the two complementary portions can be fit together precisely;

i. removing said casting model and attachments and placing a duplicate model form key in the area of said first stage mold where said model form key was located inside said casting model;

j. closing both portions of said first stage mold with said duplicate model form key inside and injecting casting wax into said first stage mold so that the wax surrounds said duplicate model form key and forms a wax pattern inside said first stage mold;

k. removing said wax portion from said first stage mold and allowing said wax pattern to cool while said duplicate model form key remains inside said wax pattern;

l. then removing said duplicate model form key from said wax pattern and surrounding said wax pattern with casting investment compound;

m. extracting the material of said wax pattern to leave a formed investment;

n. casting molten metal into said formed investment to form a finished casting to be used as the frame for said object.

11. In the art of casting metal so that the finished casting will hold a precise dimension in certain critical areas to enable the finished casting to be used as a frame for encasing an object of precise dimensions, the method of making the frame metal casting comprising the steps of:

a. selecting an object to be encased in a metal frame;
b. selecting an original casting model containing a centrally disposed cavity;
c. forming an interior portion of the upper inner wall adjacent said centrally disposed cavity of said casting model to dimensions which are substantially one percent larger than the dimensions of said object to be encased.
d. forming a transversely extending channel, the wall portion of which subtends an angle of substantially 90° into the circumference of said inner wall of said casting model, and at a location immediately adjacent said upper portion of said inner wall;
e. selecting a model form key whose dimensions are substantially one percent larger than said object to be encased;
f. chamfering an exposed perimeter of said model form key;
g. placing indexing means in said model form key;
h. placing said model form key in said centrally disposed cavity of said casting model and rigidly attaching said model form key to said inner wall of said casting model;
i. attaching a rod to an external edge portion of said casting model;
j. placing said casting model with said rod and said model form key attached into a mold, surrounding said casting model and attachments with a material of yieldable consistency and solidifying said material in the form of a completed first stage mold;
k. separating said first stage mold into opposite complementary portions and allowing a section of one edge to remain intact so that the two complementary portions can be fit together precisely;
l. removing said casting model and attachments and placing a duplicate model form key including chamfered perimeter and indexing means in the area of said first stage mold where said model form key was located inside said casting model;
m. closing both portions of said first stage mold with said duplicate model form key inside and injecting casting wax into said first stage mold so that the wax surrounds said duplicate model form key and forms a wax pattern inside said first stage mold;
n. removing said wax pattern from said first stage mold and allowing said wax pattern to cool while said duplicate model form key remains inside said wax pattern;
o. then removing said duplicate model form key from said wax model and surrounding said wax pattern with casting investment compound;
p. extracting the material of said wax pattern to leave a formed investment;
q. casting molten metal into said formed investment to form a finished casting to be used as the frame for said object.

12. In the art of casting metal so that the finished casting will hold precise dimensions in certain critical areas to enable the finished casting to be used as a frame for encasing an object of precise dimensions, the method of making the frame metal casting comprising the steps of:

a. selecting an object to be encased in a metal frame;
b. selecting an original casting model containing a cavity disposed therein;
c. forming an interior portion of the inner wall adjacent said cavity of said casting model to dimensions which are substantially one percent larger than the dimensions of said object to be encased.
d. selecting a model form key whose dimensions are substantially one percent larger than said object to be encased;
e. placing said model form key in said cavity of said casting model and rigidly attaching said model form key to said inner wall of said casting model;
f. attaching the end of a rod to a portion of said casting model;
g. placing said casting model with said rod and said model form key attached into a mold, surrounding said casting model and attachments with a material of yieldable consistency and solidifying said material in the form of a completed first stage mold;
h. separating said first stage mold into opposite complementary portions and allowing a section of one edge to remain intact so that the two complementary portions can be fit together precisely;
i. removing said casting model and attachment and placing a duplicate model form key in the area of said first stage mold where said model form key was located inside said casting model;
j. closing both portions of said first stage mold with said duplicate model form key inside and injecting casting wax into said first stage mold so that the wax surrounds said duplicate model form key and forms a wax pattern inside said first stage mold;
k. removing said wax pattern from said first stage mold;
l. then removing said duplicate model form key from said wax pattern and surrounding said wax pattern with casting investment compound;
m. extracting the material of said wax pattern to leave a formed investment;
n. casting molten metal in said formed investment to form a finished casting to be used as the frame for said object.

13. The method of making the frame metal casting as described in claim 12, including:

a. placing offset forms in said model form key to serve as indexing means;
b. placing said casting model with said rod and said model form key attached into a mold, surrounding said casting model and attachments with a material of rubber like consistency and solidifying said material in the form of a completed first stage mold.

14. The method of making the frame metal casting as described in claim 12, including:

a. selecting an object to be encased having an arcuate perimeter.

15. The method of making the frame metal casting as described in claim 12, including:

a. selecting an object to be encased having a straight sided perimeter.

16. The method of making the frame metal casting as described in claim 12, including:

a. finishing said casting by conventional means;
b. selecting a spring gold ring;
c. placing said object to be encased in the central cavity of said casting and in the upper machined portion area of said casting, and locking said object in place by placing said spring gold ring into said 90 degree angle channel.

17. The method of making the frame metal casting as described in claim 14, including:

a. finishing said casting by conventional means;
b. selecting multiple retaining members;

c. placing said object to be encased in the central cavity of said casting and in the upper machined portion area of said casting, and locking said object in place by placing said multiple retaining members into said 90 degree angle channel.

18. The method of making the frame metal casting as described in claim 14, including:

a. finishing said casting by conventional means;

b. selecting multiple retaining members;

c. placing said object to be encased in the central cavity of said casting and in the upper machined portion area of said casting, and locking said object in place by placing said multiple retaining members into said 90 degree angle channel.

* * * * *